United States Patent [19]

Johnson et al.

[11] 4,046,930

[45] Sept. 6, 1977

[54] TREATMENT OF PAPER AND TEXTILE FABRICS WITH EMULSIFIED EPOXY-SILICONES

[75] Inventors: Gordon Carlton Johnson, Armonk; Richard Bruce Metzler, Ossining, both of N.Y.

[73] Assignee: Union Carbide Corporation, New York, N.Y.

[21] Appl. No.: 702,471

[22] Filed: July 6, 1976

Related U.S. Application Data

[63] Continuation-in-part of Ser. No. 521,512, Nov. 6, 1974, abandoned.

[51] Int. Cl.[2] ..... B05D 3/02; C08G 47/04; D06M 15/66

[52] U.S. Cl. ..... 427/387; 260/46.5 Y; 260/29.2 EP; 260/29.2 M; 427/390 E; 427/391; 428/413; 428/447; 428/451; 428/452

[58] Field of Search ..... 260/29.2 EP, 29.2 M, 260/46.5 Y; 427/387, 390 E, 391; 428/413, 447, 451, 452

[56] References Cited

U.S. PATENT DOCUMENTS

| | | | |
|---|---|---|---|
| 3,294,725 | 12/1966 | Findlay | 260/29.2 |
| 3,360,491 | 12/1967 | Axon | 260/29.2 |
| 3,431,143 | 3/1969 | Johnson et al. | 427/391 X |
| 3,511,699 | 5/1970 | Johnson et al. | 427/390 E |
| 3,729,444 | 4/1973 | Bey et al. | 260/46.5 E |
| 3,755,070 | 8/1973 | Bey et al. | 162/164 |
| 3,755,071 | 8/1973 | Bey et al. | 162/184 |
| 3,763,069 | 10/1973 | Bey et al. | 260/29.2 M |

*Primary Examiner*—Michael R. Lusignan
*Attorney, Agent, or Firm*—Bernard Francis Crowe

[57] ABSTRACT

Paper and textile fabric substrates have been rendered water repellent by treatment of water-dispersible aqueous emulsions of epoxy-silicones where the emulsifying agent is an anionic sulfonate emulsifier, which is capable of forming stable aqueous emulsions of epoxy-silicones, which cure rapidly without curing catalysts.

19 Claims, No Drawings

TREATMENT OF PAPER AND TEXTILE FABRICS WITH EMULSIFIED EPOXY-SILICONES

This is a continuation-in-part of Ser. No. 521,512 filed Nov. 6, 1974, now abandoned.

BACKGROUND OF THE INVENTION

This invention pertains to a method of rendering paper and textile fabric substrates water repellent by contacting them with water-dispersible aqueous emulsions of epoxy-silicones and in particular to the use of anionic sulfonate emulsifiers.

Aqueous emulsions of epoxy-silicones have been used for sizing paper and textile fabrics using nonionic emulsifiers to prepare the water-dispersible emulsions. These previously known techniques however invariably require the use of a catalyst to obtain reasonable cure times. In the case of commercial paper board, where the presence of catalysts are undesirable, cure times of seven to ten days are required before acceptable water repellency is imparted to the paper board. Commercial grades of filter paper treated by using non-ionic emulsions of epoxy-silicones require elevated temperatures to effect cure.

Catalysts, such as, metal salts and polymer anhydrides will accelerate the rate of cure of the substrates but their use adds to water pollution problems, productions costs and also results in a short bath life for the water-dispersible emulsions of epoxy-silicones.

It is therefore an object of this invention to provide a method for imparting water repellency to paper and textile fabric substrates with water dispersible emulsions of epoxy-silicones with shorter cure times without the addition of curing catalysts.

STATEMENT OF THE INVENTION

A method of imparting water repellency to paper and textile fabric substrates has been developed which comprises contacting the substrates with a water-dispersible aqueous emulsion of an epoxy-silicone having the formula:

$$MD_xU_yM'_q \qquad \text{I}$$

wherein D represents an $R_2SiO$ unit in which R is a monovalent hydrocarbon radical free of acetylenic unsaturation; U represents a unit selected from the class consisting of $$R-\overset{\overset{\displaystyle R'}{|}}{Si}-O \quad \text{and } R'Si-O_{3/2}$$

in which R is defined above and R' is a monovalent organic radical containing at least one vicinal epoxy group,

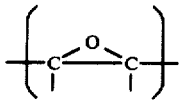

M and M' are in each occurrence an end blocking unit having the formula:

$$R''_{3-a}\overset{\overset{\displaystyle R'_a}{|}}{Si}-O_{1/2}$$

in which R'' is a monovalent hydrocarbon radical free of olefinic unsaturation, R' is as defined above, $a$ has a value from 0 to 1 inclusive, $q$ has a value of 1 when U is an $$R-\overset{\overset{\displaystyle R'}{|}}{Si}-O$$

unit and a value of $(y + 1)$ when U is an $$R'SiO_{3/2}$$

unit, $x$ is an integer having a value of from 10 to about $10^5$, $y$ is a integer having a value of 1 to $10^2$, the sum of $x$, $y$, and $q$ being such that the epoxy-silicone compound $MD_xU_yM'_q$ has a molecular weight of from $10^3$ to about $10^6$ and the ratio of epoxy-containing unit to units containing no epoxy groups is within the range of from about 0.001 to 0.5, said epoxy-silicone being employed in an amount of from about 0.01 to about 4 weight percent based on the weight of dry substrate, the improvement which consists of producing an aqueous emulsion for application to said substrates by emulsifying said epoxy-silicone using about 1 to 25 weight percent based on weight of said epoxy-silicone of an anionic sulfonate emulsifier capable of producing an aqueous emulsion of said epoxy-silicone, having a maximum water absorption on paper at 49° C. for 3 minutes of about 0.6 g./100 $cm^2$ when measured by the Cobb Test in accordance with TAPPI-T-441.

It is to be understood that the overall average molecular weight of the epoxy-silicone used is not narrowly critical. Whereas silicones having molecular weights of several thousand, viz., one thousand to fifty thousand perform advantageously the only significant limitation on the maximum molecular weight values is the high viscosity of very high molecular weight polymeric epoxy-silicones. Although very viscous epoxy-silicones are still suitably employed they are inconvenient to utilize and thus are not preferred.

Illustrative of the monovalent hydrocarbon radicals represented by R in the $R_2SiO_{1/2}$ and $$R-\overset{\overset{\displaystyle R'}{|}}{Si}-O_{1/2}$$

units defined above for U are alkyl groups containing from 1 to 10 carbon atoms, preferably 1 to 6 carbon atoms such as methyl, ethyl, propyl, butyl, isobutyl, amyl, hexyl, octyl, and decyl; alkenyl groups such as vinyl, allyl, butadienyl, 1-pentenyl and the like; aryl radicals including fused ring structures such as phenyl, p-phenylphenyl, naphthyl, anthryl and the like; alkaryl radicals such as tolyl, xylyl, p-vinylphenyl, $\beta$-methylnaphthyl, and the like; aralkyl radicals such as stearyl, phenyl methyl and phenylcyclohexyl; and cycloalkyl radicals such as cyclopentyl, cyclohexyl and cyclobutyl. Preferred R radicals are alkyl with methyl being particularly preferred.

The monovalent organic radicals represented by R' which contain epoxy groups are, exclusive of the oxirane oxygen necessarily present, preferably hydrocarbon radicals free of acetylenic unsaturation or containing in addition to carbon and hydrogen only ether or carbonyl oxygen. Such R' radicals include 3,4-epoxycyclohexyl; 6-methyl-3,4-epoxycyclohexyl; 6-methyl-3,4-epoxycyclohexyl; 3-oxatricyclo[3.2.1.0$^{2,4}$]-octane-6-propyl; 7-butyl-3-oxatricyclo[3.2.1.0$^{2,4}$]octane-6-methyl; 3,4-epoxycyclohexyl-1-ethyl; 9,10-epoxystearyl; γ-glycidoxypropyl; p-(2,3-epoxybutyl)phenyl; and 3-(2,3-epoxybutyl)-cyclohexyl. The vicinal epoxy group can be but need not be a terminal group of the R′ radical. Moreover, the R′ radical can be simply a

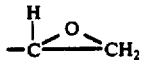

radical directly joined to silicon. A variety of epoxy-silicones which are hereinbefore defined are illustrated structurally and further characterized with respect to physical properties in J.A.C.S., Vol. 81, at pages 2632–2635, E. P. Plueddemann et al.

Because of ready availability of precursors and the excellent results obtained using the final product the preferred units of Formula I above are M = M′ = $(CH_3)_3SiO_{1/2}$ and D = $(CH_3)_2SiO$. More particularly preferred are the silicones containing these M and D units in combination with at least one U unit of the formula:

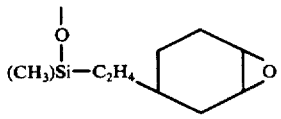

or

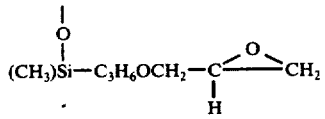

which polymers have the structure $MD_xU_yM$ wherein $y$ is an integer having a value of from about 5 to about 15 and $x$ is an integer having a value of from about 200 to about 600.

The aforesaid silicones are well known in the art and can conveniently be prepared, among other methods, by the platinum catalyzed addition of aliphatically unsaturated epoxy compounds to hydrosiloxanes, the ratio of reactants being such as to prevent the presence of unreacted, i.e., residual, hydrosiloxane moieties. It is to be understood however that trace hydrosiloxane contamination in the silicone can be tolerated without unduly affecting the compositions and processes of this invention, but preferably the silicone is hydrosiloxane-free. By trace amounts of hydrogen-siloxane is meant not more than that amount which will produce about 2 cc. hydrogen per gram of silicon by the NaOH gas evolution method.

Although the prior art has disclosed that the above group of epoxy-silicones may be emulsified with either non-ionic, catonic or anionic emulsifiers, there was no recognition of the unexpected property that those anionic sulfonate emulsifiers which form aqueous emulsions with the epoxy-silicones described herein also act as catalysts to effect rapid curing of these epoxy-silicones.

Not all anionic emulsifiers possess the unusual properties exhibited by the anionic sulfonate emulsifiers of this invention. Thus for example sulfuric acid esters or alcohol sulfates such as lauryl sulfate, sodium 2-ethyl hexyl sulfate, alkylaryl polyether sulfates and the like, carboxylic acid salts such as morpholine oleate, and aromatic phosphate esters do not exhibit as rapid a curing effect as that shown by the sulfonates of this invention.

Furthermore, even an alkali metal salt of a sulfonate, sodium lignin sulfonate, is ineffective alone for preparing aqueous emulsions of the epoxy-silicones of this invention.

Preferred sulfonates include alkali metal dialkyl sulfosuccinates containing 14 to 22 carbons, alkali metal, morpholine and alkanolamine salts of alkylaryl sulfonic acids containing 1 to 18 carbons in the alkyl group and 6 to 10 carbons in the aryl group, alkali metal salts of alkylaryl polyether sulfonic acids having 1 to 18 carbons in the alkyl group and 6 to 10 in the aryl group, alkali metal salts of alkyl naphthalene sulfonic acids having 1 to 18 carbons in the alkyl group, and alkane sulfonates, such as, commercially available petroleum sulfonates having about 6 to 24 carbons and $C_{17}H_{33}CON(CH_3)—C_2H_4SO_3Na$, available as Igepon T-43.

Particularly preferred anionic emulsifiers are the triethanolamine salt of an alkylaryl sulfonic acid commercially available as Richonate S-1280, the sodium salt of an alkyl aryl polyether sulfonate commercially available as Triton X-202, the sodium salt of an alkyl naphthalene sulfonate commercially available as Alkanol BG.

While the catalysis of the curing of the epoxy-silicones is unique to these anionic emulsifiers, they may be used in conjunction with non-ionic or polymeric emulsifiers, such as, polyvinyl alcohol if desired.

Another advantage of the use of anionic sulfonate emulsifiers over non-ionic emulsifiers in water dispersible aqueous emulsions of epoxy-silicones is that the former may be used in a neutral pH medium whereas the latter require an acid pH medium. This is often undesirable since acid pH causes weakening of paper and particularly textile fibers as well as causing corrosion of manufacturing equipment.

While about 1 to about 25 percent of anionic sulfonate emulsifier based on the weight of epoxy-silicone can be used in this invention, it is preferred to use about 1 to about 10 weight percent and even more preferred to use about 3 to about 5 weight percent.

The amount of water used in preparing aqueous emulsions of the epoxy-silicones defined herein with the anionic sulfonate emulsifiers defined hereinabove is not critical. It is within the knowledge of those skilled in the art to choose the desired amount depending on the desired solids content of the emulsified epoxy-silicone. This is delineated infra in the examples describing emulsion preparations where a grease is first prepared from a mixture of anionic sulfonate emulsifier and water blended with epoxy-silicone oil.

Further incremental additions, that is, dropwise additions of water to the grease with agitation convert the latter to a milky white emulsion. The emulsion remains stable regardless of how much more water is added.

While about 0.01 to about 4 weight percent of the epoxy-silicone based on the weight of the substrate can be used to gain the advantages of this invention, it is preferred to use about 0.025 to about 0.5 weight percent.

The aqueous emulsions of this invention may be applied to paper and textile fabric substrates by any of the various techniques known in the art for surface application. On paper these include application by means of a water box on a calender, tub sizing, size press, transfer roll, spraying and the like. The emulsions can be applied either before, during or after the paper forming operation.

The addition of the active agent, i.e., the epoxy-silicone to the paper fibers prior to the time when they are interfelted into a relatively low water content, self-supporting sheet is conventionally termed "wet end sizing". Similarly, when the epoxy-silicone is applied to the already formed paper the process is referred to as "dry end sizing".

If desired retention aids well known in the art can be used for the application of the epoxy-silicones to the pulp fibers. These include gums, starches, and resins such as polyethyleneimine, sulfonium metal sulfate salt of an acrylic acid-acrylamide copolymer, cationic starches, cationic silicones, polyamine epichlorohydrin and carboxymethyl cellulose.

While statements have been made that epoxy-silicones emulsified with aqueous solutions of non-ionic emulsifiers can be used without benefit of catalysts or elevated temperatures, the length of time needed for curing is so great that it is not practical in many cases to employ this technique. This invention now reveals a method for gaining fast curing times without the benefit of catalysts or elevated temperatures. This is not to say that catalysts cannot also be used if still faster curing times are desired. A suitable catalyst often used by paper makers is aluminum sulfate. This can be alternatively added in a separate application at the dry end or added directly to the diluted emulsion of epoxy-silicone. Other catalysts which may be used if desired include the metal salts of strong acids such as zinc nitrate and polymeric anhydrides, such as, poly(methyl vinyl ether/maleic anhydride), poly(styrene/maleic anhydride), and tetrapropenylsuccinic anhydride.

On textiles, a typical method of application is that known in the art as dip-pad-dry. The emulsion may be applied after all other finishing operations have been completed or may be applied along with other finishing agents. As in the case of paper treating no catalyst is needed to obtain fast cures but if desired the catalysts enumerated above and also metal soaps such as zinc 2-ethyl hexoate or dibutyl tin diacetate or laurate may be used in textile fabric finishing operations using the emulsion for this invetion. The metal salts enumerated above are generally used in a ratio of 0.1 to 10 parts by weight to 100 parts of epoxy-silicone and more commonly about 2 parts of the former to one hundred parts of the latter.

For textile finishing the epoxy-silicone emulsion of this invention can be applied in conjunction with modifying resins and other textile finishing materials. These other finishing materials include starch, other water repellents, either organic or silicone type, oil repellents, wash-wear resins, organic softeners and lubricants, dyes and pigments, anti-slip agents and the like. The epoxy modified silicones have been applied in conjunction with wash-wear resins (dimethylolethylene urea or triazone), and excellent water repellency, softness and tear strength was obtained.

The invention is further described in the examples which follow. All parts and percentages are by weight unless otherwise specified.

EXAMPLE 1

The criticality of choosing a satisfactory emulsifier for the preparation of aqueous emulsions of the epoxy-silicones of this invention is demonstrated below where the triethanolamine salt of dodecyl benzene sulfonic acid, Richonate S-1280 sold by the Richardson Co., was employed. In contrast as shown in Control 1 when sodium lignin sulfonate (sold as Marasperse N-22 by American Can Co.) was substituted for the Richonate S-1280 no emulsification at all took place.

EMULSIFICATION OF EPOXY-SILICONE OIL WITH RICHONATE S-1280

Richonate S-1280 (2.2 grams) was mixed with 2.2 grams of distilled water in a beaker using a guarded stirring paddle in a Lightnin' Mixer. A gelatinous mixture formed which is characteristic of an effective emulsifier. Then 70.0 grams of L-9300 epoxy silicone oil was added very slowly to the beaker, a few drops at a time with continued stirring. A "grease" was formed. The "grease" can be described as a translucent stiff, bouncy mass similar in consistency to partially dried rubber cement. Then 125.6 grams of water was added, dropwise initially, while stirring. As the water was worked into the "grease", the "grease" first became milky white and assumed the consistency of shaving cream. A thick but homogeneous oil-in-water emulsion had already formed after the addition of 10 grams of water. As more water was added, the material slowly thinned to a milky homogeneous liquid constituting an emulsion of L-9300 epoxy silicone oil in water. The final emulsion consisted of 35% L-9300, 1.1% Richonate S-1280 and 63.9% distilled water.

CONTROL I

Example 1 was repeated using exactly the same proportions of L-9300 epoxy silicone oil and distilled water, with the exception that 1.1% by weight of Marasperse N-22 (sodium lignin sulfonate) was substituted for the 1.1 weight % Richonate S-1280. Specifically 2.2 grams of Marapserse N-22 was mixed with 2.2 grams of distilled water in a beaker using a glass stirring rod until the Marasperse N-22 had dissolved. The mixture at this point was a very dark brown liquid, slightly more viscous than water. While stirring using a guarded stirring paddle in a Lightnin' mixer, 70.0 grams of L-9300 epoxy silicone oil was then added very slowly, a few drops at a time. Addition of the first 10 to 15 grams of epoxy silicone oil caused the mixture to thicken to about the consistency of cake frosting. Further addition of the epoxy silicone oil resulted in thinning of the materials to a moderately viscous liquid. No grease was formed. This phenomenon would discourage one skilled in the art from further attempting emulsification of the epoxy silicone oil since successful emulsifying agents will form a grease at this point in the procedure as evidenced in Example 1 above. However, even though a grease could not be formed, the addition of 125.6 grams of water was made dropwise while stirring, exercising the same care as used to successfully prepare the emulsion of Example 1.

By the time 10 to 15 grams of water had been added, it was evident that an emulsion was not being formed. The mixture was not homogeneous. Small droplets of water separated and bounced on the walls of the beaker as stirring was continued. As more water was added, the separation became gross and two separate phases were presented, viz., a brown, sticky, viscous oil phase and a clear water phase.

EXAMPLE 2

An epoxy silicone sizing agent was prepared by mixing together 8.75 grams of a 2 centistoke trimethyl endblocked dimethylpolysiloxane, 18.0 grams of a trimethyl endblocked methylhydrogenpolysiloxane, 974.8 grams dimethylpolysiloxane cyclics (depolymerizate) and 20 grams concentrated sulfuric acid. After agitating this mixture for 2½ hours, the viscosity increased to form a viscous fluid. To this was added 200 cc of toluene and 50 grams of sodium bicarbonate. The composition was stirred for 1 hour and then heated to 180° C. and sparged with nitrogen at 2 liters/minute for 2 hours. When cool the material was filtered. The resulting oil had a viscosity of 3000 centipoises, a hydroxyl content less than 0.1 weight percent, and a silanic hydrogen content of 6.3 cc. $H_2$/gram using the caustic hydrogen evolution test. 400 Grams of this fluid were mixed with 100 grams isopropylether, 1414 grams vinyl-3,4-epoxycyclohexane, and 10 parts per million platinum in the form of chloroplatinic acid. The resulting mixture was heated to 85° C. and the rapid refluxing indicated an exothermic reaction had occurred. After heating 2 hours at 85° C., 1 gram benzothiazole was added, and mixed for 10 minutes. The polymer was cooled and filtered using a filter aid. The polymer was returned to a kettle and sparged with 2 liters $N_2$/minute at 135° C. When solvent no longer was being removed, the material was vacuum sparged at <40 mm. pressure for 1 hour. The product had the following analysis; epoxy content, 1.0±0.3%, silanic hydrogen, 1.2 cc. $H_2$/g.

This product corresponds to the formula:

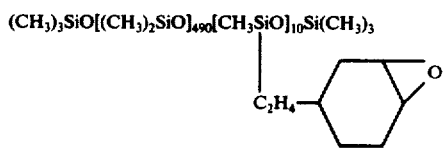

An aqueous emulsion of the epoxy-silicone prepared above was prepared using 3% of an anionic surfactant based on the weight of epoxy silicone as described in Example 1. The anionic sulfonate emulsifier, Richonate S-1280 was however replaced by the morpholine salt of dodecyl-benzene sulfonic acid (Richonic Acid B sold by Richardson Company). The room temperature stability of this emulsion was six months.

The water emulsion prepared above was tested for its ability to impart water repellency to samples of 80 × 80 cotton print cloth using the Spray Rating test for water repellency, Test Method 22-1971 of the American Assoc. of Textile Chemists & Colorists (AATCC) at a 1.2 percent loading of epoxy-silicone using 0.03 percent of zirconium acetate as a catalyst in one set of tests and no catalyst in another set of tests. The cure time on Whatman No. 3 filter paper treated with 0.05 percent aluminum sulfate was measured by recording the time for the Cobb value to reach a minimum. The Cobb test is a measure of water repellency which consists of exposing a specific surface area of the paper to water for a given time and measuring the amount of water absorbed by the gain in weight. This test is described in TAPPI (Technical Association of the Pulp and Paper Industry) Standard T-441. Unless otherwise noted in this and other succeeding examples, the Cobb test was made using water 49° C. exposed to the paper for 3 minutes. The room temperature stability of the emulsion so prepared was also observed. The results obtained are delineated in Table I together with a comparison of other emulsions prepared with both the anionic emulsifiers of this invention and the nonionic emulsifiers of the prior art. As can be seen from an examination of these data only the narrow class of anionic emulsifiers specified above functions to afford short cure times on paper coupled with high spray ratings on the cotton print cloth. In most cases the added benefit of good room temperature stability was also obtained. In contrast the nonionic emulsion

TABLE I

| Test | Emulsifier | Spray Rating-Cotton Catalyzed | Spray Rating-Cotton Uncatalyzed | Cure Time Paper | Room Temp. Stability |
|---|---|---|---|---|---|
| A | Morpholine salt of dodecyl benzene sulfonic acid (anionic) | 100 | 90 | 0 | 6 months |
| B | Triethanolamine salt of dodecyl benzene sulfonic acid (anionic) | 90 | 90 | 2 minutes | 6 months |
| C | Sodium salt of dodecyl benzene sulfonic acid (anionic) | 100 | 80 | <5 minutes | 6 months |
| D | Sodium salt of alkylaryl polyether sulfonate[a] (anionic) | 100 | 70 | <5 minutes | Creams |
| Control A | Sodium 2-ethyl hexyl sulfate (anionic) | 90 | 80 | 5 minutes | Creams |
| Control B | Sodium Salt of alkylaryl polyether sulfate[b] (anionic) | 90 | 70 | 5 minutes | Separates |
| Control C | Sodium lauryl sulfate[c] plus polyvinyl alcohol (anionic) | — | — | 10 min. | Creams |
| Control D | Organic ester of phosphoric acid morpholine salt[d] | 80 | — | <15 minutes | 4 Months |

TABLE I-continued

| Test | Emulsifier | Spray Rating-Cotton Catalyzed | Spray Rating-Cotton Uncatalyzed | Cure Time Paper | Room Temp. Stability |
|---|---|---|---|---|---|
| Control E | (anionic) Nonylphenol/ethylene oxide adduct (1:20) plus trimethylnonanol (non-ionic) | 70–80 | 50–70 | 15 minutes | 6 Months |

(a)Triton X-202 (Rohm and Haas Co.)
(b)Triton X-301 (Rohm and Haas Co.)
(c)Dupanol WAQ (duPont Co.)
(d)GAFAC RE-610 (GAF Corp.)

of the same epoxy-silicone is markedly inferior as are other anionic emulsifiers which are outside the ambit of this invention.

EXAMPLE 3

Example 2 was repeated with varying portions of reactants to give several examples of epoxy-silicone where the x and y values of the general formula $MD_x—U_yM'_q$ were varied to demonstrate the broad applicability of the preferred emulsion disclosed herein. These were made to varying epoxy contents and also evaluated as emulsions for treatments of cotton print-cloth, Dacron-cotton, and Whatman No. 3 filter paper. The results obtained are presented in Table II. These data demonstrate that the anionic emulsions prepared from the triethanolamine salt of dodecyl benzene sulfonic acid give much faster cure times on filter paper as compared with the nonionic emulsion. The spray rating of these anionic emulsions was also observed to be excellent.

EXAMPLE 4

The sizing of various paper substrates was evaluated using the epoxy-silicone prepared as in Example 2 emulsified with the morpholine salt of dodecyl benzene sulfonic acid. Newsprint, unbleached Kraft and reclaimed Kraft and newsprint were used in this evaluation. The results compared with Control F having no epoxy-silicone on the paper substrate are presented in Table III.

TABLE III-continued

| Paper Substrate | Water Absorption by Cobb Test TAPPI Test Method T-441: No Silicone Control F | Paper treated with Anionic Emulsion of Epoxy-Silicone | Cobb Test Time(1) |
|---|---|---|---|
| reclaimed Kraft and newsprint | 150 g/m² | 110 g/m² | 2 hours |

(1)Water at 27° C. exposed to paper for designated time.

The significant amount of water repellency imparted to all three types of paper is amply demonstrated by these data.

EXAMPLE 5

A comparison of the water repellency imparted to 80 × 80 cotton print cloth and 65/35 Dacron/cotton poplin by a nonionic epoxy-silicone water emulsion of the prior art and an anionic emulsion of the same epoxy-silicone was made. Spray ratings were taken with the treated cotton print cloth and cotton poplin initially after treatment and then after one wash and five washes performed in conformity with the American Association of Textile Chemists and Colorists (AATCC) test method 124-1967 with a machine wash at about 60°–63° C. The treatment of the print cloth and poplin was effected by dipping the fabric in the dilute emulsion, padding off the excess and drying the treated fabric in a forced air oven at 160° C. for 5 minutes. This standard procedure is referred to by those skilled in the art as dip-pad-dry. The results presented in Table IV are those obtained with a nonionic emulsion of the epoxy-silicone prepared in Example 2 emulsified with nonylphenol-/ethylene oxide adduct (1:20) plus trimethylnonanol. The anionic emulsion employed the morpholine salt of dodecyl-benzene sulfonic acid with the epoxy-silicone prepared in Example 2. The data in Table IV clearly show the superiority of the anionic emulsion over the non-ionic emulsion.

TABLE II

| Epoxy-silicone | % Epoxy | Anionic Emulsion Spray Rating (1) Cotton | Anionic Emulsion Spray Rating (1) Dacron/Cotton | Time to cure on Paper(2) non-ionic emulsion(3) | Time to cure on Paper(2) Anionic emulsion (4) |
|---|---|---|---|---|---|
| $M\ D_{204}\ U_9\ M'$ | 2.4 | 100 | 90 | 30 minutes | 0 minutes |
| $M\ D_{358}\ U_9\ M'$ | 1.3 | 100 | 90+ | — | 0 minutes |
| $M\ D_{490}\ U_{10}\ M'$ | 0.94 | 90+ | 90 | 15 minutes | 2 minutes |

(1)Emulsifier: triethanolamine salt of dodecyl benzene sulfonic acid; Catalyst: Zirconium acetate; Loading: 1.2% based on weight of fabric
(2)Time for water absorption to reach mininum on Whatman No. 3 filter paper treated with alum; Water absorption measured by Cobb Test, TAPPI T-441; water at 49° C. exposed to paper for 3 minutes.
(3)Emulsifier: Nonylphenol/ethylene oxide adduct (1:20) plus trimethylnonanol
(4)Emulsifier: Triethanolamine salt of dodecyl benzene sulfonic acid.

TABLE III

| Paper Substrate | Water Absorption by Cobb Test TAPPI Test Method T-441: No Silicone Control F | Paper treated with Anionic Emulsion of Epoxy-Silicone | Cobb Test Time(1) |
|---|---|---|---|
| newsprint | 110 g./m² | 25 g/m² | 180 seconds |
| unbleached Kraft | 40 g./m² | 2 g/m² | 180 seconds |

TABLE IV

| Emulsifier | Load %[2] | Spray Ratings[1] 80 × 80 Cotton Print Cloth Initial | 1 Wash | 5 Washes | 65/35 Dacron/Cotton Poplin Initial | 1 Wash | 5 Washes |
|---|---|---|---|---|---|---|---|
| Non-ionic | 1.6 | 80 | 70 | 70 | 70 | 70 | 70 |
| | 1.2 | 70 | 70 | 70 | 70 | 70 | 70 |
| | 0.8 | 70 | 70− | 50 | 70 | 70 | 70 |
| | 0.4 | 70 | 70− | 50 | 80− | 70 | 70− |
| Anionic | 1.6 | 100 | 80 | 70 | 100 | 90− | 80 |
| | 1.2 | 90 | 80 | 70 | 100 | 80+ | 80 |
| | 0.8 | 90 | 80 | 70 | 90+ | 80+ | 80 |
| | 0.4 | 80 | 70 | 70− | 90+ | 80 | 80− |

[1]AATCC Test Method 22-1971 Condition: At least 24 hours before Spray Rating Wash: AATCC 124-1967, Machine Wash at 60-63° C.
[2]Based on weight of fabric.

TABLE V

| Aluminum Sulfate Conc., % | Water Absorption (g/100 cm²)[1] Cure 15 min. at 90° C. Non-ionic Emulsifier | Anionic Emulsifier | Cure 60 min. at 90° C. Non-ionic Emulsifier | Anionic Emulsifier |
|---|---|---|---|---|
| 0.032 | 0.55 | 0.50 | 0.50 | 0.40 |
| 0.016 | 2.49 | 0.50 | 0.50 | 0.43 |
| 0.008 | 3.62 | 0.86 | 1.67 | 0.50 |
| 0.002 | 3.42 | | 3.67 | 2.66 |

[1] Cobb Test, TAPPI T-441. Water at 49° C. exposed to paper for 3 minutes.

EXAMPLE 6

The superiority of the anionic emulsion of the epoxy-silicone prepared in Example 2 over that of the non-ionic emulsion of the same epoxy-silicone using the same emulsifiers as in Example 5 was demonstrated by applying the curing emulsions to Whatman No. 3 filter paper treated with decreasing amounts of aluminum sulfate and curing at 90° C. for 15 minutes and 60 minutes respectively. The data obtained presented in Table V again demonstrate the superiority of the anionic emulsified epoxy-silicone over that of the nonionic emulsified epoxy-silicone as to imparting water repellency to paper. This water absorption test was carried out using the Cobb Test.

EXAMPLE 7

The superiority of the anionic emulsifiers outlined above over nonionic emulsifiers for the room temperature treatment of Whatman No. 3 filter paper was demonstrated using the epoxy-silicone prepared in Example 2 emulsified with each of seven emulsifiers. The data presented in Table VI show that all of the anionic emulsifiers are significantly superior in reducing the water absorption of the papers treated with the emulsified epoxy-silicone after drying for two hours at room temperature.

EXAMPLE 8

A further demonstration of the superiority of the anionic emulsions of this invention over the prior art nonionic emulsions was demonstrated by the improved

TABLE VI

| Emulsifier | Water absorption (g/100cm.²) [1] after drying 2 hours at room temperature |
|---|---|
| Nonylphenol/ethylene oxide adduct (1:20) plus trimethylnonanol (Non-ionic) | 3.64, 3.50 |
| Morpholine salt of dodecyl benzene sulfonic acid (anionic) | 0.40 |
| Sodium salt of dodecyl benzene sulfonic acid (anionic) | 0.55 |
| Triethanolamine salt of dodecyl benzene sulfonic acid (anionic) | 0.60 |
| Sodium salt of alkyl naphthalene sulfonate (anionic) | 0.42 |
| Sodium salt of dioctyl-sulfosuccinate (anionic) | 0.62 |
| $C_{17}H_{33}C(=O)-N(CH_3)-C_2H_4SO_3Na$ (Anionic) | 0.40 |

TABLE VI-continued

[1]Cobb test - TAPPI-T-441; 49° C. water exposed to paper for 3 minutes water resistance imparted by an aqueous emulsion prepared by emulsifying the epoxy-silicone of Example 2 with nonylphenol/ethylene oxide adduct (1:20) plus trimethylnonanol (non-ionic) and one prepared by emulsifying the same epoxy-silicone with the morpholine salt of dodecylbenzene sulfonic acid (anionic). This improved water resistance was demonstrated by a water drop penetration test with Whatman No. 3 filter paper which was previously treated in one case with the nonionic emulsion and in another with the anionic emulsion by dipping the filter papers into the dilute emulsions and drying at room temperature for about 18 hours. A Control of filter paper was also used untreated with either emulsion. The time required for a water drop to be completely absorbed by a sample of Whatman No. 3 filter paper took two seconds in the case of the untreated sample, 17 seconds in the case of the non-ionic emulsion treated paper and 71 seconds in the case of the anionic emulsion treated paper.

EXAMPLE 9

The effectiveness of the anionic emulsified epoxy-silicone over that of the non-ionic epoxy-silicone at lower loadings was also demonstrated using the Cobb test for water absorption (TAPPI Method T-441). Whatman No. 3 filter paper was treated with the nonionic and anionic emulsified epoxy-silicone solutions respectively and cured for 30 minutes at 90° C. The differences between the two emulsions is demonstrated by the data presented in Table VII.

TABLE VII

| Concentration of Epoxy-Silicone in Emulsified Bath | Loading of Epoxy-silicone on Paper | Water Absorption (g./100cm.²)[1] Non-ionic Emulsion | Anionic Emulsion |
|---|---|---|---|
| 0.1% | 0.16% | 0.52 | 0.45 |
| 0.05% | 0.10% | 0.75 | 0.50 |
| 0.025% | 0.06% | 3.24 | 1.92 |

[1] Cobb test (TAPPI T-441) 49° C. water exposed to paper for 3 minutes

Although the invention has been described in its preferred forms with a certain degree of particularity, it is understood that the present disclosure of the preferred forms has been made only by way of example and that numerous changes may be resorted to without departing from the spirit and scope of the invention.

What is claimed is:

1. In the method of imparting water repellency to paper and textile fabric substrates which comprises contacting the substrates with a water-dispersible aqueous emulsion of an epoxy-silicone having the formula:

$$MD_xU_yM'_q$$

wherein D represents an $R_2SiO$ unit in which R is a monovalent hydrocarbon radical free of acetylenic unsaturation; U represents a unit selected from the class consisting of $$\begin{array}{c} R' \\ | \\ R-Si-O \end{array} \text{ and } R'SiO_{3/2}$$

in which R is as defined above and R' a monovalent organic radical containing at least one vicinal epoxy group,

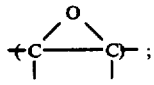

M and M' are in each occurrence an endblocking unit having the formula $$R''_{3-a}\overset{R'_a}{\overset{|}{Si}}O_{1/2}$$

in which R'' is a monovalent hydrocarbon radical free of olefinic unsaturation, R' is as defined above, $a$ has a value from 0 to 1 inclusive, $q$ has a value of 1 when U is an $$\begin{array}{c} R' \\ | \\ R-SiO \end{array}$$

unit and a value of $(y + 1)$ when U is an $R'SiO_{3/2}$ unit, $x$ is an integer having a value of from 10 to about $10^5$, $y$ is an integer having a value of from 1 to about $10^2$, the sum of $x$, $y$ and $q$ being such that the epoxy-silicone compound $MD_xU_yM'$ has a molecular weight of from about $10^3$ to about $10^6$ and the ratio of epoxy-containing units to units containing no epoxy groups is within the range of from about 0.001 to 0.5, said epoxy-silicone being employed in an amount of from about 0.01 to about 4 weight % based on the weight of dry substrate, the improvement which consists of producing an aqueous emulsion for application to said substrates by emulsifying said epoxy-silicone in water using about 1 to 25 weight %, based on the weight of said epoxy-silicone, of an anionic sulfonate emulsifier capable of producing an aqueous emulsion of said epoxy-silicone having a maximum water absorption on paper at 49° C. for 3 minutes of about 0.6 g./100 $cm^2$ when measured by the Cobb Test in accordance with TAPPI-T-441.

2. Method claimed in claim 1 wherein the anionic sulfonate emulsifier is selected from the group consisting of salts of an alkylaryl sulfonic acid, alkali metal salts of a dialkyl sulfosuccinic acid, alkali metal salts of an alkylaryl polyether sulfonic acid, alkali metal salts of an alkyl naphthalene sulfonic acid, and alkali metal salts of an alkane sulfonic acid.

3. Method claimed in claim 2 wherein the emulsifier is a salt of an alkylaryl sulfonic acid.

4. Method claimed in claim 3 wherein the salt is an alkali metal salt.

5. Method claimed in claim 3 wherein the salt is a morpholine salt.

6. Method claimed in claim 3 wherein the salt is an alkanolamine salt.

7. Method claimed in claim 2 wherein the emulsifier is an alkali metal dialkyl sulfosuccinate.

8. Method claimed in claim 2 wherein the emulsifier is an alkylaryl polyether alkali metal sulfonate salt.

9. Method claimed in claim 2 wherein the emulsifier is an alkyl naphthalene sulfonate alkali metal salt.

10. Method claimed in claim 1 wherein the emulsifier is an alkane sulfonate.

11. Composition suitable for imparting water repellency to paper and textile fabric substrate consisting of a water-dispersible aqueous emulsion of an epoxy-silicone having the formula:

$$MD_xU_yM'_q$$

wherein D represents a $R_2SiO$ unit in which R is a monovalent hydrocarbon radical free of acetylenic unsaturation; U represents a unit selected from the class consisting of $$\begin{array}{c} R' \\ | \\ R-Si-O \end{array} \text{ and } R'-SiO_{3/2}$$

in which R is as defined above and R' is a monovalent organic radical containing at least one vicinal epoxy group,

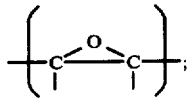

M and M' are in each occurrence an end blocking unit having the formula:

$$R''_{3-a}\overset{R'}{\overset{|}{Si}}O_{\frac{1}{2}}$$

in which R'' is a monovalent hydrocarbon radical free of olefinic unsaturation, R' is as defined above, $a$ has a value from 0 to 1 inclusive, has a value of 1 when U is an $$\begin{array}{c} R' \\ R-SiO \end{array}$$

unit and a value of $(y + 1)$ when U is an $R'SiO_{3/2}$ unit, $x$ is an integer having a value of from 10 to about $10^5$, $y$ is an integer having a value of from 1 to about $10^2$, the sum of $x$, $y$, and $q$ being such that the epoxy-silicone compound $MD_xU_yM'_q$ has a molecular weight of from about $10^3$ to about $10^6$ and the ratio of epoxy-containing units to units containing no epoxy groups is within the range of from about 0.001 to 0.5, said epoxy-silicone being employed in an amount of from about 0.01 to about 4 weight % based on the weight of dry substrate, emulsified in water with about 1 to about 25 weight % of an anionic sulfonate emulsifier, based on the weight of the epoxy-silicone, capable of producing an aqueous emulsion of said epoxy-silicone having a maximum water absorption on paper at 49° C. for 3 minutes of about 0.6 g./100 $cm^2$ when measured by the Cobb Test in accordance with TAPPI-T-441.

12. Composition claimed in claim 11 wherein the anionic sulfonate emulsifier is selected from the group consisting of salts of an alkylaryl sulfonic acid, alkali metal salts of a dialkyl sulfosuccinic acid, alkali metal salts of an alkylaryl polyether sulfonic acid, alkali metal salts of an alkyl naphthalene sulfonic acid, and alkali metal salts of an alkane sulfonic acid.

13. Composition claimed in claim 12 wherein the emulsifier is a salt of an alkylaryl sulfonic acid.

14. Composition claimed in claim 13 wherein the salt is an alkali metal salt.

15. Composition claimed in claim 13 wherein the salt is an alkanolamine salt.

16. Composition claimed in claim 12 wherein the emulsifier is an alkali metal salt of a dialkyl sulfosuccinic acid.

17. Composition claimed in claim 12 wherein the emulsifier is an alkali metal salt alkylaryl polyether sulfonic acid.

18. Composition claimed in claim 12 wherein the emulsifier is an alkali metal salt of an alkyl naphthalene sulfonic acid.

19. Composition claimed in claim 12 wherein the emulsifier is an alkali metal salt of an alkane sulfonic acid.

* * * * *